US009634436B2

(12) United States Patent
Yu et al.

(10) Patent No.: US 9,634,436 B2
(45) Date of Patent: Apr. 25, 2017

(54) ELECTRICAL CONNECTOR WITH LOCKING STRUCTURES FOR ASSEMBLING CONTACT MODULES

(71) Applicant: ALLTOP ELECTRONICS (SUZHOU) LTD., Taicang, JiangSu Province (CN)

(72) Inventors: Wang-I Yu, Jhonghe (TW); I-Hung Cheng, Jhonghe (TW); Kuo-Cheng Liu, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 391 days.

(21) Appl. No.: 14/289,147

(22) Filed: May 28, 2014

(65) Prior Publication Data

US 2015/0249296 A1 Sep. 3, 2015

(30) Foreign Application Priority Data

Feb. 28, 2014 (CN) ..... 2014 1 0071062

(51) Int. Cl.

*H01R 13/6587* (2011.01)
*H01R 107/00* (2006.01)
*H01R 13/518* (2006.01)

(52) U.S. Cl.

CPC ..... *H01R 13/6587* (2013.01); *H01R 13/518* (2013.01); *H01R 2107/00* (2013.01)

(58) Field of Classification Search

USPC ..... 439/629, 660, 701, 626, 607.05, 607.07
See application file for complete search history.

(56) References Cited

U.S. PATENT DOCUMENTS 6,638,079 B1 * 10/2003 Billman ..... H01R 13/514 439/76.1
6,997,755 B2 * 2/2006 Varis ..... H01R 23/6873 439/108
7,074,086 B2 * 7/2006 Cohen ..... H01R 23/688 439/607.08
7,651,337 B2 * 1/2010 McNamara ..... H01R 13/514 439/65
7,963,806 B1 * 6/2011 Scott Kline ..... H01R 13/642 439/607.08
8,226,441 B2 * 7/2012 Regnier ..... H01R 9/038 439/626
8,267,721 B2 * 9/2012 Minich ..... H01R 12/724 439/607.05
8,540,525 B2 * 9/2013 Regnier ..... H01R 29/00 439/79

(Continued)

*Primary Examiner* — Alexander Gilman
(74) *Attorney, Agent, or Firm* — Sughrue Mion, PLLC

(57) ABSTRACT

An electrical connector includes an insulative housing, a number of first contact modules, a number of second contact modules and a number of third contacts all assembled into the insulative housing. Each first contact module includes a first wafer and first contacts insert-molded in the first wafer. Each second contact module includes a second wafer and second contacts insert-molded in the second wafer. The first contact modules, the second contact modules and the third contacts are arranged side by side after being inserted into the insulative housing. The adjacent first wafer and the second wafer cooperatively include mutual locking structures so that they can be inserted into the insulative housing in turn under a predetermined sequence.

18 Claims, 9 Drawing Sheets

(56) References Cited

U.S. PATENT DOCUMENTS

| | | | | |
|---|---|---|---|---|
| 8,657,631 | B2 * | 2/2014 | Lang | H01R 12/716 439/607.08 |
| 8,747,158 | B2 * | 6/2014 | Szczesny | H01R 4/04 439/607.07 |
| 9,054,432 | B2 * | 6/2015 | Yang | H01R 9/24 |
| 9,160,123 | B1 * | 10/2015 | Pao | H01R 12/716 |
| 9,385,466 | B2 * | 7/2016 | Henry | H01R 13/506 |
| 2002/0098724 | A1 * | 7/2002 | Cohen | H01R 13/514 439/80 |
| 2002/0168898 | A1 * | 11/2002 | Billman | H01R 13/514 439/607.07 |
| 2006/0189212 | A1 * | 8/2006 | Avery | H01R 12/724 439/607.05 |
| 2012/0040563 | A1 * | 2/2012 | Wang | H01R 12/721 439/626 |
| 2012/0322313 | A1 * | 12/2012 | Hsu | H01R 13/514 439/629 |
| 2013/0130550 | A1 * | 5/2013 | Wozniak | H01R 12/585 439/607.23 |
| 2015/0118907 | A1 * | 4/2015 | Pan | H01R 13/6474 439/607.1 |
| 2015/0171557 | A1 * | 6/2015 | Pao | H01R 13/6587 439/676 |

* cited by examiner

ELECTRICAL CONNECTOR WITH LOCKING STRUCTURES FOR ASSEMBLING CONTACT MODULES

BACKGROUND

1. TECHNICAL FIELD

The present disclosure relates to an electrical connector, and more particularly to an electrical connector with locking structures for combining contact modules so that the contact modules can be prevented from being incorrectly assembled.

2. DESCRIPTION OF RELATED ART

With rapid development of electronic technologies, electrical connectors have been widely used in electronic devices for exchanging information and data with external equipments. A conventional electrical connector usually includes an insulative housing and a plurality of contacts received in the insulative housing. In order to meet the requirements of stable signal transmission and high effective transmission of the electronic devices, strong mating stabilization of the electrical connectors needs to be ensured.

A current Mini SAS connector usually includes a plurality of signal contact modules and a plurality of grounding contacts associated with the signal contact modules. Each signal contact module includes an insulative wafer and a plurality of signal contacts insert-molded in the insulative wafer. Each grounding contact is usually stamped from a metal sheet. In assembling, the signal contact modules and the grounding contacts are side by side inserted into the insulative housing. However, since there lacks of any mutual locking structures, the signal contact modules and the grounding contacts can sometimes be incorrectly assembled under a wrong order or a wrong arrangement. In other words, the signal contact modules and the grounding contacts can be easily inserted into incorrect positions of the insulative housing, which may result in inconvenience assembly and may cause damage.

However, it is desirable to provide an electrical connector with locking structures for assembling contact modules.

SUMMARY

The present disclosure includes an electrical connector including an insulative housing, a plurality of first contact modules, a plurality of second contact modules and a plurality of third contacts all assembled into the insulative housing. The insulative housing includes a mounting portion and a mating portion extending forwardly from the mounting portion along a longitudinal direction. The mating portion includes a mating surface and a plurality of contact-receiving slots extending through the mating surface. The mounting portion includes a mounting surface and a mounting space extending through the mounting surface. Each first contact module includes a first wafer and a plurality of first contacts fixed in the first wafer. Each first contact includes a first contact portion extending forwardly beyond the first wafer, a first mounting leg extending downwardly beyond the first wafer and a first connecting portion insert-molded in the first wafer. Each second contact module includes a second wafer and a plurality of second contacts fixed in the second wafer. Each second contact includes a second contact portion extending forwardly beyond the second wafer, a second mounting leg extending downwardly beyond the second wafer and a second connecting portion insert-molded in the second wafer. Each third contact includes a flat main portion, a plurality of third contact portions extending forwardly from the main portion and a plurality of third mounting legs extending downwardly from the main portion. The first contact modules, the second contact modules and the third contacts are accommodated in the mounting space with the first contact portions with the second contact portions and the third contact portions extending into corresponding contact-receiving slots. One of the first contact modules, one of the second contact modules and one of the third contacts are arranged side by side along a transverse direction perpendicular to the longitudinal direction. One of the first wafers and one of the second wafers cooperatively comprise mutual locking structures so that the one of the first wafers and the one of the second wafers can be inserted into the mounting space in turn under a predetermined sequence.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
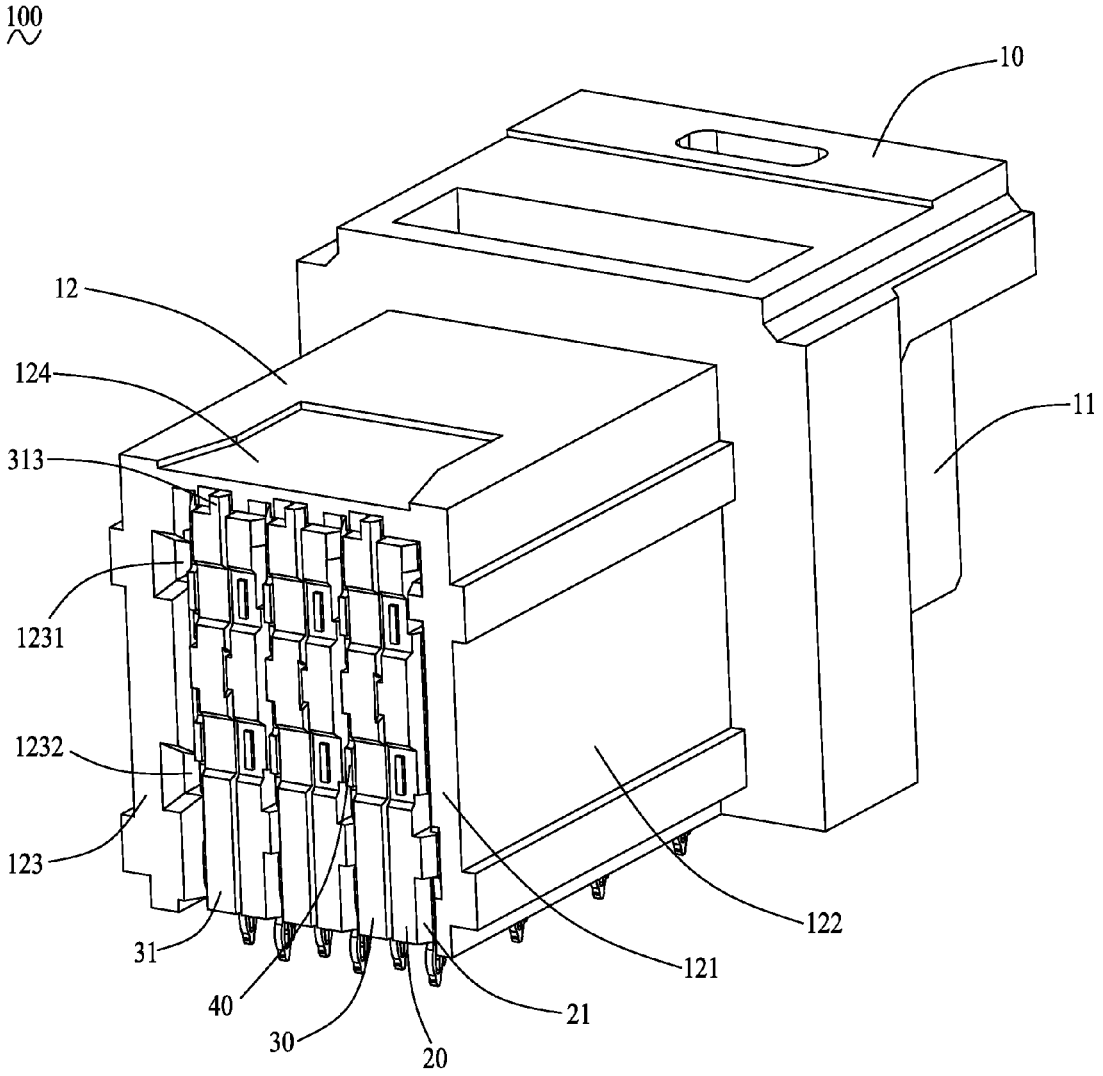
FIG. 1 is a perspective view of an electrical connector in accordance with an illustrated embodiment of the present disclosure.

Reference will now be made to the drawing figures to describe the embodiments of the present disclosure in detail. In the following description, the same drawing reference numerals are used for the same elements in different drawings.

Figure 2:
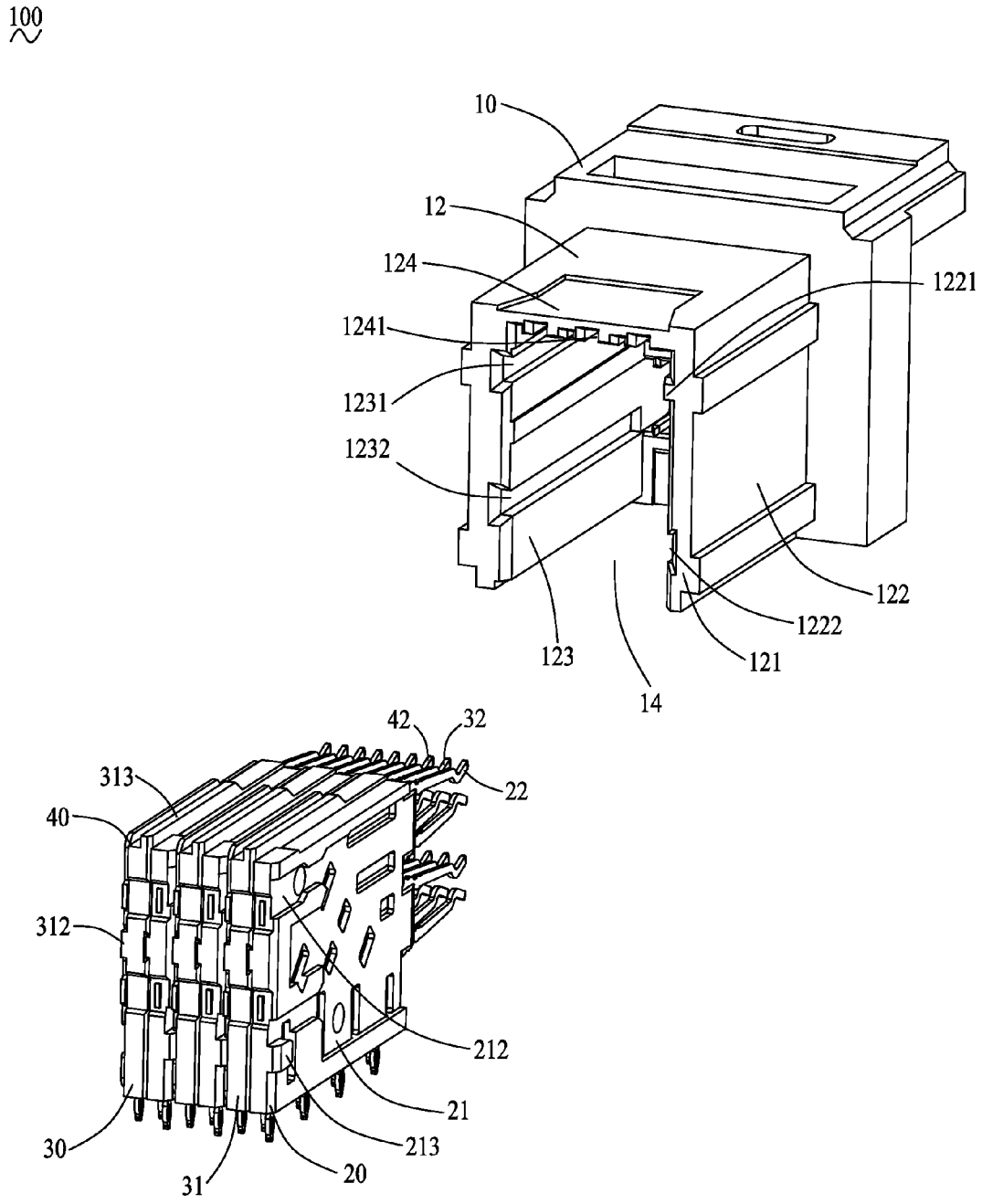
FIG. 2 is a partly exploded view of the electrical connector as shown in FIG. 1 with first contact modules, second contact modules and third contacts separated therefrom.

Referring to FIGS. 1 and 2, an illustrated embodiment of the present disclosure discloses an electrical connector 100, i.e., a Mini SAS connector. The electrical connector 100 is adapted to be mounted on a circuit board (not shown) for mating with a complementary connector (not shown). The electrical connector 100 includes an insulative housing 10, a plurality of first contact modules 20, a plurality of second contact modules 30 and a plurality of third contacts 40 all assembled to the insulative housing 10. Each first contact module 20 includes a first wafer 21 and a plurality of first contacts 22 insert-molded in the first wafer 21. Similarly, each second contact module 30 includes a second wafer 31 and a plurality of second contacts 32 insert-molded in the second wafer 31.

Figure 3:
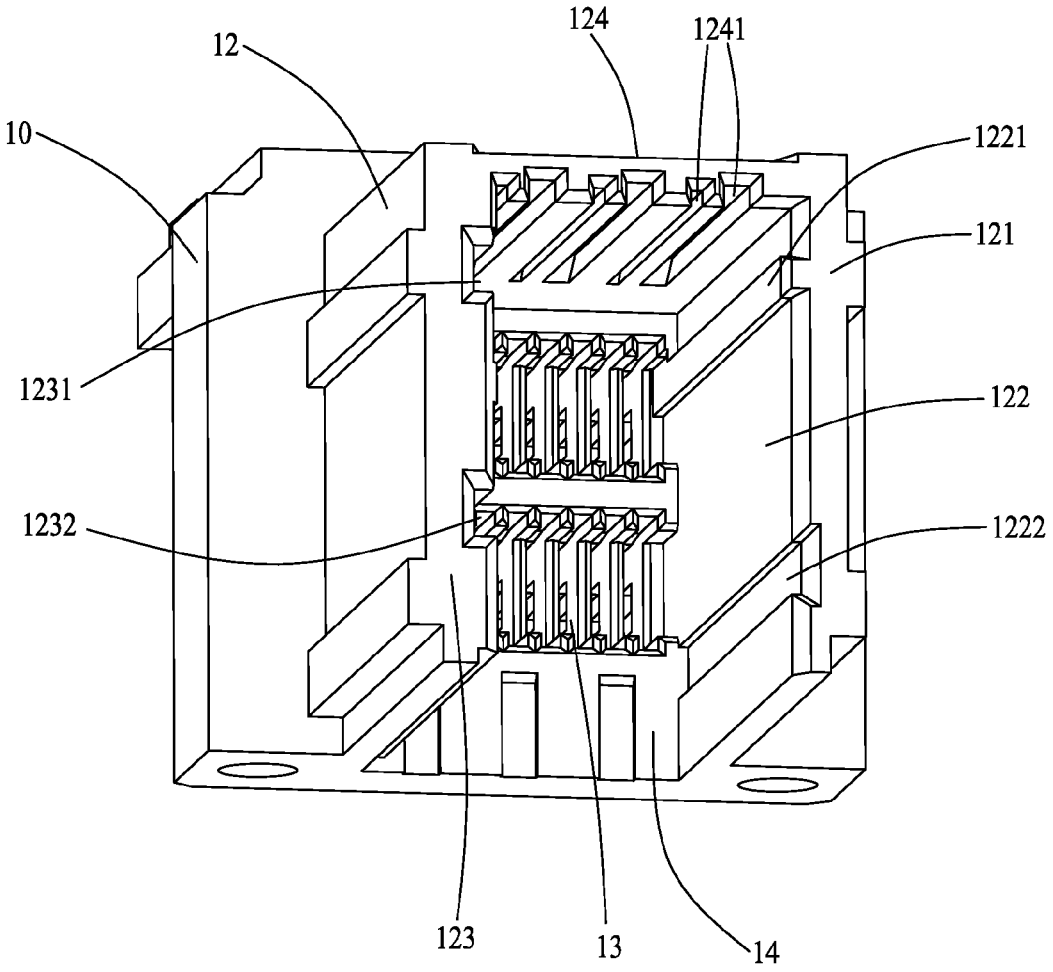
FIG. 3 is a rear perspective view of an insulative housing as shown in FIG. 1.
Figure 4:
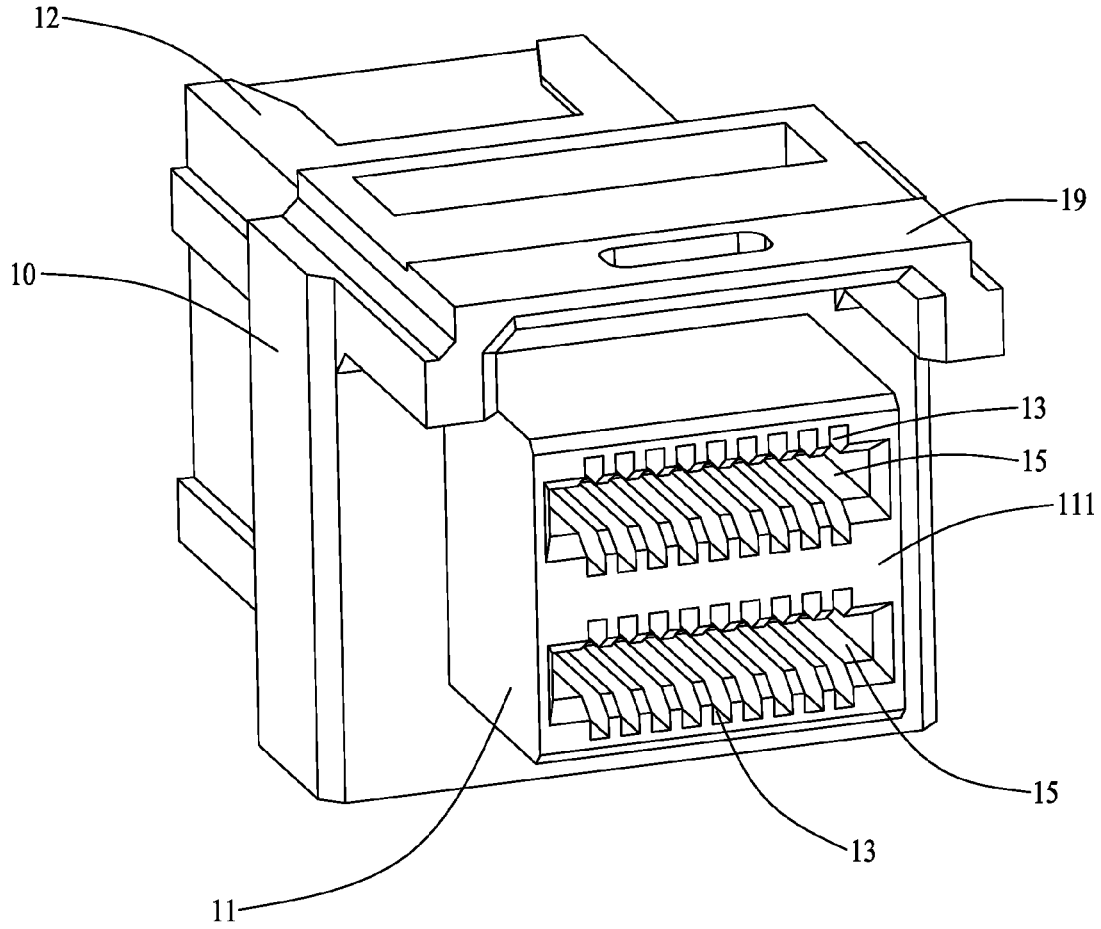
FIG. 4 is a front perspective view of the insulative housing as shown in FIG. 1.

Referring to FIGS. 3 and 4, the insulative housing 10 includes a mounting portion 12, a mating portion 11 extending forwardly from the mounting portion 12 along a longitudinal direction and a reversed U-shaped cap 19 located on top of the mating portion 11. The mating portion 11 includes a mating surface 111, two plug receiving slots 15 extending forwardly through the mating surface 111 and a plurality of contact-receiving slots 13 extending through the mating surface 111. The contact-receiving slots 13 are located at upper and lower sides of each plug receiving slot 15 and in communication with corresponding plug receiving slot 15.

Referring to FIGS. 1 to 3, the mounting portion 12 includes a mounting surface 121 opposite to the mating surface 111 and a mounting space 14 extending backwardly through the mounting surface 121. As shown in FIG. 3, the mounting portion 121 includes a top wall 124, a first side wall 122 and a second side wall 123 extending downwardly from opposite sides of the top wall 124. The mounting space 14 is reversed U-shaped and is formed by the top wall 124, the first side wall 122 and the second side wall 123. The first contact modules 20, the second contact modules 30 and the third contacts 40 are all assembled into the mounting space 14 along a rear-to-front direction with the first contacts 22, the second contacts 32 and the third contacts 40 extending into corresponding contact-receiving slots 13. As shown in FIG. 1, after being assembled in position, the first contact modules 20, the second contact modules 30 and the third contacts 40 are arranged side by side along a transverse direction perpendicular to the longitudinal direction.

Referring to FIG. 3, the top wall 124 includes a plurality of guiding slots 1241 in communication with the mounting space 14 for receiving the second contact modules 30 and the third contacts 40. The first side wall 122 includes a first rib 1221 and a first groove 1222 below the first rib 1221. Both the first rib 1221 and the first groove 1222 extend along the front-to-rear direction. The first rib 1221 protrudes into the mounting space 14. The first groove 1222 is in communication with the mounting space 14. The second side wall 123 includes a second groove 1231 and a third groove 1232 one above the other. The second groove 1231 and the third groove 1232 are in communication with the mounting space 14.

Figure 5:
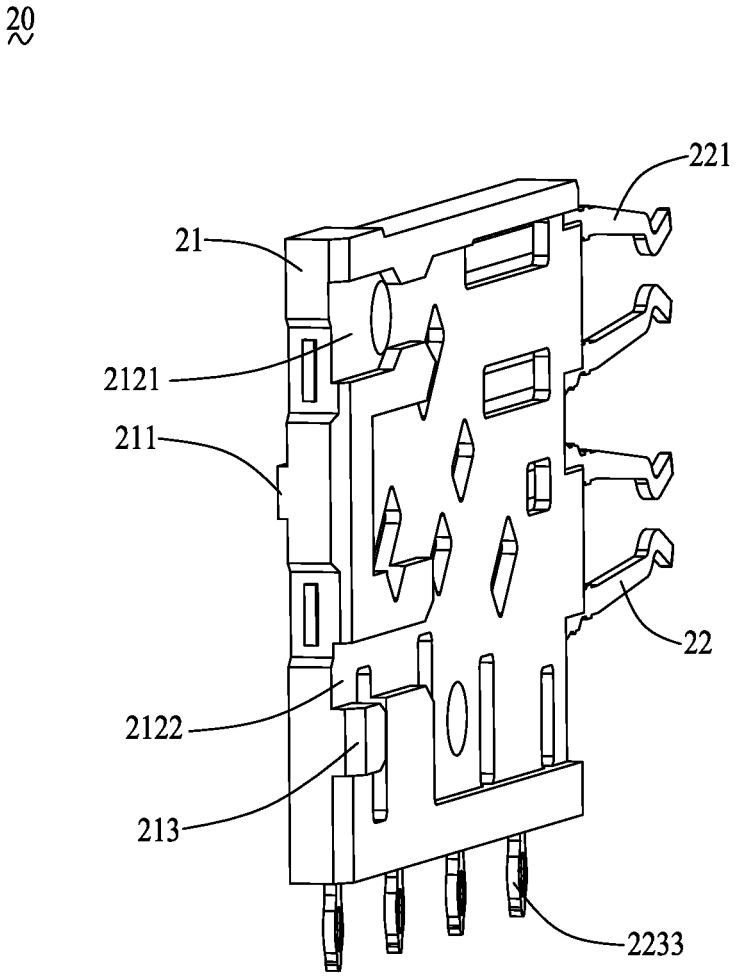
FIG. 5 is a perspective view of one of the first contact module.

Referring to FIG. 5, each first wafer 21 includes a first protrusion 211 formed on a first side, a second protrusion 213 formed on a second side opposite to the first side, a first slot 2121 recessed on the second side and a second slot 2122 recessed on the second side. The first slot 2121, the second slot 2122 and the second protrusion 213 are arranged in turn along a vertical direction.

Referring to FIGS. 1, 2, 5 and 6, each first contact 22 includes a first contact portion 221, a first mounting leg 223 perpendicular to the first contact portion 221 and a first connecting portion 222 connecting the first contact portion 221 and the first mounting leg 223. The first connecting portion 222 is insert-molded in the first wafer 21. According to the illustrated embodiment of the present disclosure, four first contacts 22 are insert-molded in a single first wafer 21. The four first contact portions 221 are arranged along the vertical direction and are divided into two groups each of which protrudes into corresponding plug receiving slot 15. The four first mounting legs 223 are arranged in a line along the front-to-rear direction.

Each first contact portion 221 includes a plurality of first barbs 2211 extending vertically therefrom so that the first contact portion 221 can be securely fixed in corresponding contact-receiving slot 13. Each first mounting leg 223 is serpentine and includes a first extension 2231 extending from the first connecting portion 222, a first inclined portion 2232 extending from the first extension 2231 and a first press-fit leg 2233 extending downwardly from the first inclined portion 2232. The first inclined portion 2232 extends along a direction opposite to the mating surface 111.

Figure 7:
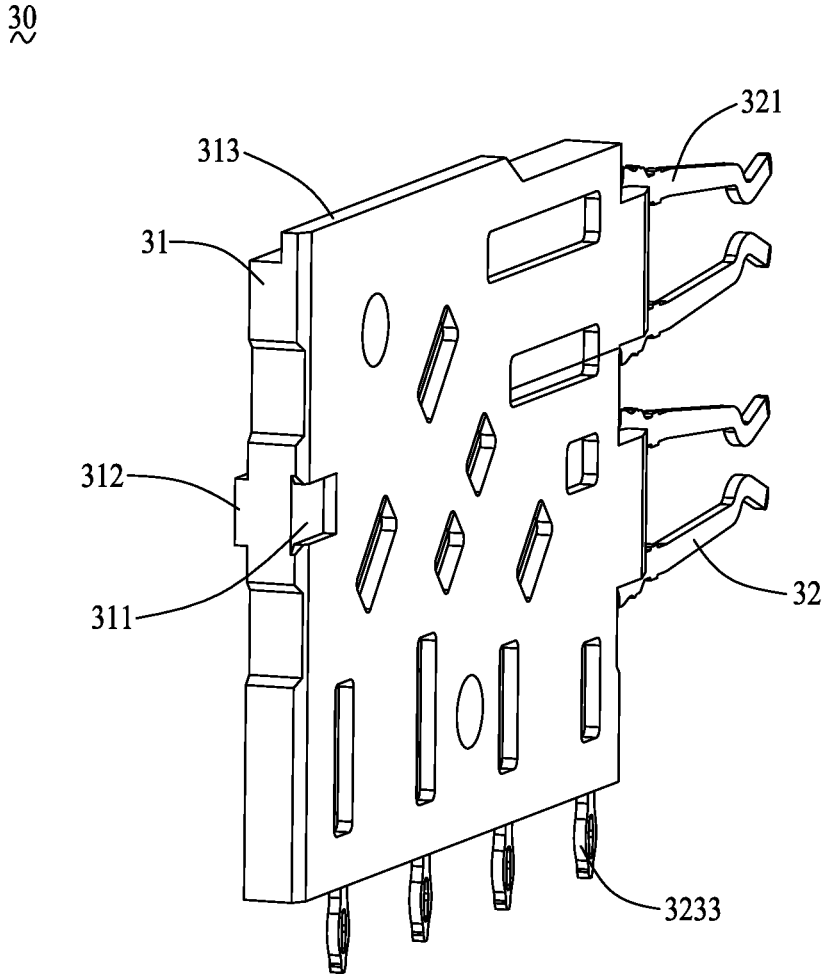
FIG. 7 is a perspective view of one of the second contact module.

Referring to FIG. 7, each second wafer 31 includes an embossment 312 formed on one side, a recess 311 formed on the other side opposite to the embossment 312 and an upper protrusion 313 which is received in corresponding guiding slot 1241. As shown in FIG. 2, the upper protrusion 313 is positioned nearer to an adjacent first wafer 21 than to an adjacent third contact 40.

Referring to FIGS. 1, 2, 7 and 8, each second contact 32 includes a second contact portion 321, a second mounting leg 323 perpendicular to the second contact portion 321 and a second connecting portion 322 connecting the second contact portion 321 and the second mounting leg 323. The second connecting portion 322 is insert-molded in the second wafer 31. According to the illustrated embodiment of the present disclosure, four second contacts 32 are insert-molded in a single second wafer 31. The four second contact portions 321 are arranged along the vertical direction and are divided into two groups each of which protrudes into corresponding plug receiving slot 15. The four second mounting legs 323 are arranged in a line along the front-to-rear direction.

Each second contact portion 321 includes a plurality of second barbs 3211 extending vertically therefrom so that the second contact portion 321 can be securely fixed in corresponding contact-receiving slot 13. Each second mounting leg 323 is serpentine and includes a second extension 3231 extending from the second connecting portion 322, a second inclined portion 3232 extending from the second extension 3231 and a second press-fit leg 3233 extending downwardly from the second inclined portion 3232. The second inclined portion 3232 extends along a direction towards the mating surface 111.

Figure 6:
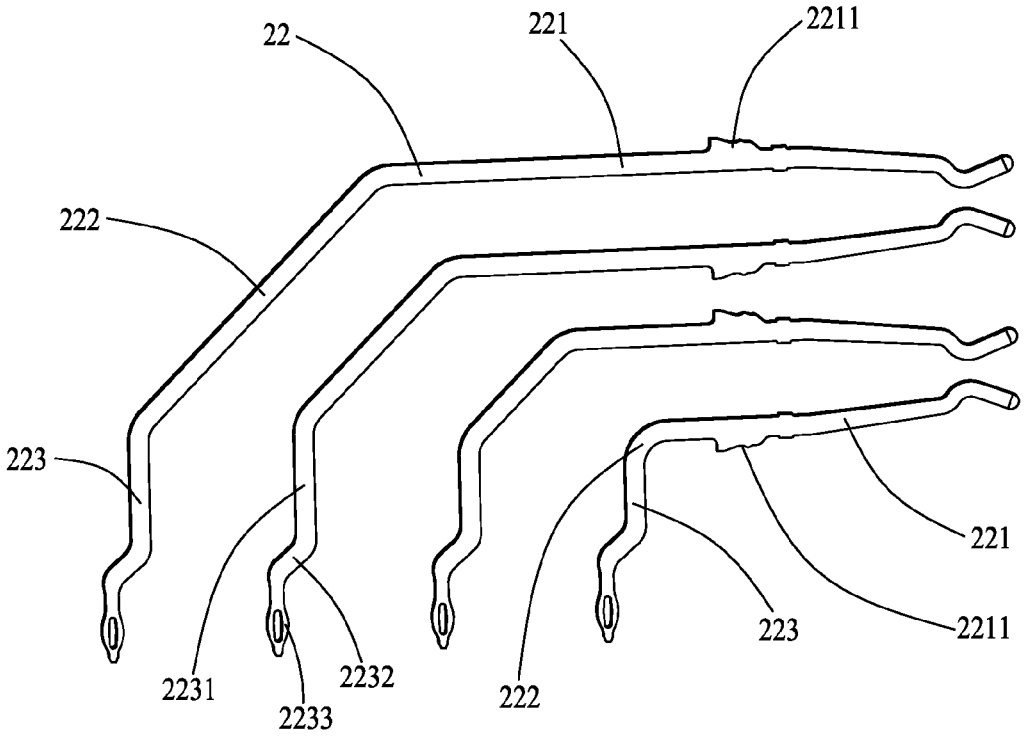
FIG. 6 is a side view of first contacts mounted in a single first contact module.
Figure 8:
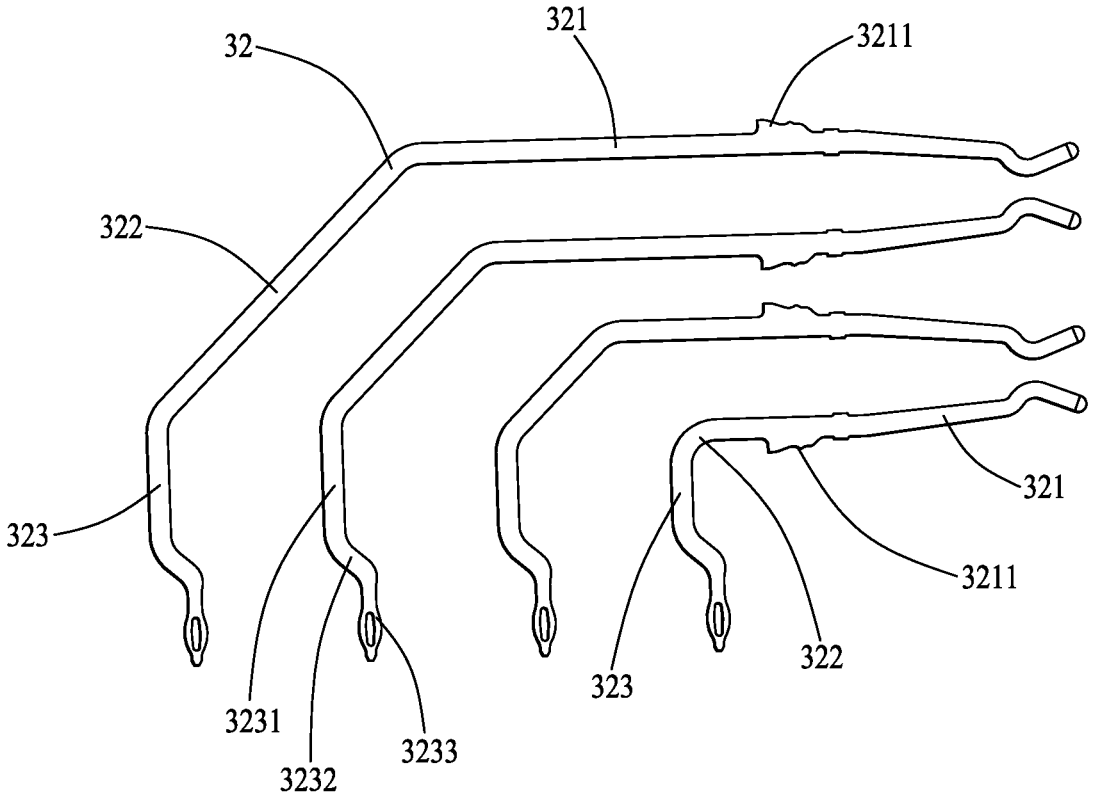
FIG. 8 is a side view of second contacts mounted in a single second contact module.

Referring to FIGS. 6 and 8, the four first contacts 22 and the four second contacts 32 are essentially of the same configuration except the inclined direction of the first inclined portions 2232 and the second inclined portions 3232. As a result, the first mounting legs 223 and the second mounting legs 323 are offset with each other along the transverse direction, which can improve mounting stability to the circuit board.

Figure 9:
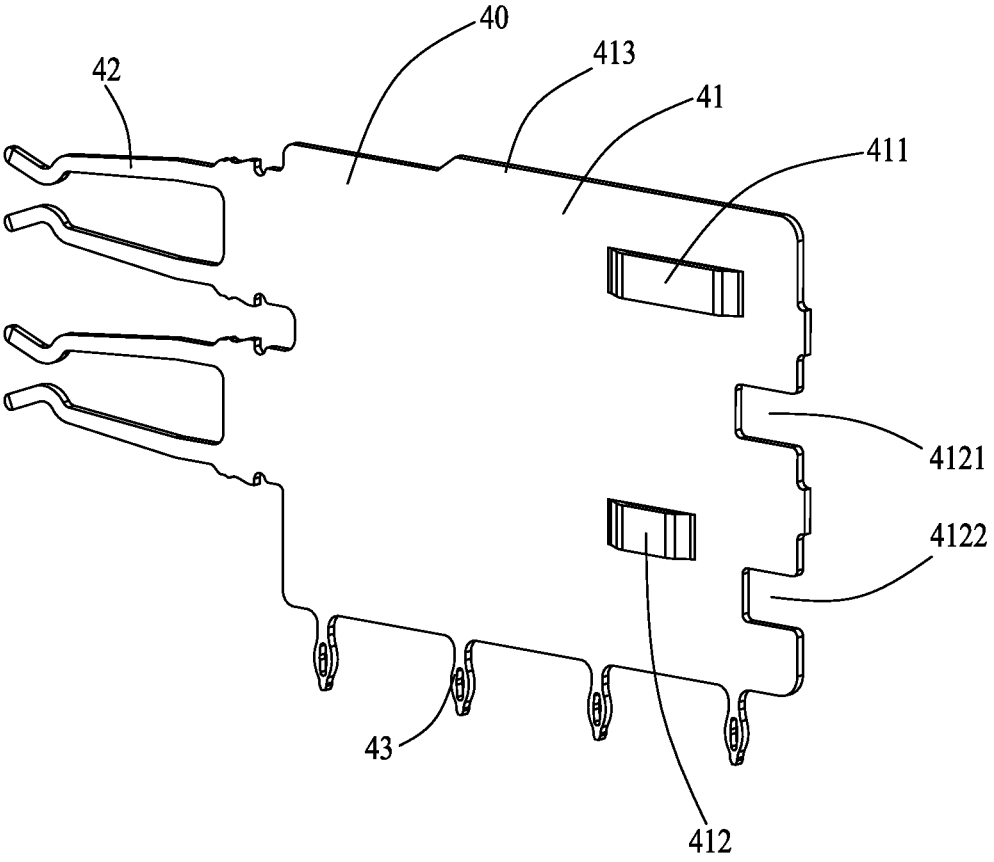
FIG. 9 is a perspective view of one of the third contacts.

Referring to FIG. 9, each third contact 40 includes a flat main portion 41, a plurality of third contact portions 42 extending forwardly from the main portion 41 and a plurality of third mounting legs 43 extending downwardly from the main portion 41. According to the illustrated embodiment of the present disclosure, each single third contact 40 has four third contact portions 42 which are the same as the first contact portions 221 and the second contact portions 321. As shown in FIG. 2, the first contact portions 221, the second contact portions 321 and the third contact portions 42 are in alignment with each other along the transverse direction. The first mounting legs 223, the second mounting legs 323 and the third mounting legs 43 are offset with each other along the transverse direction, which can improve mounting stability to the circuit board. The main portion 41 is stamped to form a first projection 411 and a second projection 412 under the first projection 411. Besides, the main portion 41 includes a first cutout 4121 and a second cutout 4122 formed at a rear edge thereof. Furthermore, the main portion 41 includes a top protrusion 413 which is received in corresponding guiding slot 1241 for positioning.

Referring to FIGS. 1 and 2, it is understandable that the first contacts 22 and the second contacts 32 are signal contacts, and the third contacts 40 are grounding contacts. According to the illustrated embodiment of the present disclosure, the first contacts 22 and the second contacts 32 cooperatively form a plurality of broad-side coupled differential pairs. As shown in FIG. 2, the rightmost three components consisting of one first contact module 20, one second contact module 30 and one third contact 40 cooperatively form a SSG group. According to the illustrated embodiment of the present disclosure, there are three such groups. Each adjacent two components of the first contact modules 20, the second contact modules 30 and the third contacts 40 include mutual locking/mating structures so that they can be inserted into the mounting space 14 in turn under a predetermined sequence.

Referring to FIGS. 1 and 2, When the first contact modules 20, the second contact modules 30 and the third contacts 40 are received in the mounting space 14, the first rib 1221 is received in the first slot 2121 of the outmost first wafer 21, and simultaneously, the second protrusion 213 is received in the first groove 1222. As a result, the outmost first wafer 21 can be fixed to the first side wall 122. Only the first wafer 21 can be fixed with the first side wall 122 for avoiding incorrect insertion. Regarding the locking structures of adjacent the first contact module 20 and the second contact module 30, the first protrusion 211 is received in the recess 311. Regarding the mating structures of adjacent the second contact module 30 and the third contact 40, the embossment 312 is received in the first cutout 4121. It is understandable that, regarding the first wafers 21 rather than the outmost one, the second protrusion 213 is received in the second cutout 4122 of adjacent main portion 41. Regarding the outmost third contact 40, the first projection 411 and the second projection 412 are received in the second groove 1231 and the third groove 1232, respectively.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector comprising:

an insulative housing comprising a mounting portion and a mating portion extending forwardly from the mounting portion along a longitudinal direction, the mating portion comprising a mating surface and a plurality of contact-receiving slots extending through the mating surface, the mounting portion comprising a mounting surface and a mounting space extending through the mounting surface;

a plurality of first contact modules each comprising a first wafer and a plurality of first contacts fixed in the first wafer, each first contact comprising a first contact portion extending forwardly beyond the first wafer, a first mounting leg extending downwardly beyond the first wafer and a first connecting portion insert-molded in the first wafer;

a plurality of second contact modules each comprising a second wafer and a plurality of second contacts fixed in the second wafer, each second contact comprising a second contact portion extending forwardly beyond the second wafer, a second mounting leg extending downwardly beyond the second wafer and a second connecting portion insert-molded in the second wafer;

a plurality of third contacts each comprising a flat main portion, a plurality of third contact portions extending forwardly from the main portion and a plurality of third mounting legs extending downwardly from the main portion; wherein the first contact modules, the second contact modules and the third contacts are accommodated in the mounting space with the first contact portions, the second contact portions and the third contact portions extending into corresponding contact-receiving slots; and wherein one of the first contact modules, one of the second contact modules and one of the third contacts are arranged side by side along a transverse direction perpendicular to the longitudinal direction; and wherein one of the first wafers and one of the second wafers cooperatively comprise mutual locking structures so that the one of the first wafers and the one of the second wafers can be inserted into the mounting space in turn under a predetermined sequence; and wherein the mounting portion comprises a top wall which comprises a plurality of guiding slots in communication with the mounting space to position the second contact modules and the third contacts, the one of the second wafers comprising an upper protrusion which is received in corresponding guiding slot, the upper protrusion being positioned nearer to the one of the first wafers than to an adjacent main portion of the third contacts.

2. The electrical connector as claimed in claim 1, wherein the mutual locking structures comprise a first protrusion formed on the one of the first wafers and a recess formed on the one of the second wafers, the first protrusion being received in the recess.

3. The electrical connector as claimed in claim 2, wherein the one of the first wafers comprises a second protrusion opposite to the first protrusion, and the mounting portion comprises a first side wall which further defines a groove to receive the second protrusion.

4. The electrical connector as claimed in claim 3, wherein the one of the first wafers comprises a first slot on top of the second protrusion, and the first side wall comprises a first rib received in the first slot.

5. The electrical connector as claimed in claim 1, wherein the one of the second wafers and one of the main portions of the third contacts cooperatively comprise mutual mating structures so that the one of the second wafers and the one of the main portions can be associated with each other.

6. The electrical connector as claimed in claim 5, wherein the one of the second wafers comprises an embossment, and the one of the main portions comprises a first cutout to receive the embossment.

7. The electrical connector as claimed in claim 5, wherein the one of the main portions comprises a first projection stamped therefrom, and another first wafer adjacent to the one of the main portions comprises a first slot to receive the first projection.

8. The electrical connector as claimed in claim 7, wherein the one of the main portions comprises a second projection stamped therefrom, and the another first wafer comprises a second slot to receive the second projection, the second projection being positioned under the first projection, the second projection being shorter than the first projection.

9. The electrical connector as claimed in claim 1, wherein an outmost main portion of the third contacts comprises two projections, and the mounting portion comprises a second side wall which further comprises two grooves to receive the two projections.

10. The electrical connector as claimed in claim 1, wherein the first contact portions, the second contact portions and the third contact portions being in alignment with each other along the transverse direction while the first mounting legs, the second mounting legs and the third mounting legs are offset with each other along the transverse direction.

11. An electrical connector comprising:

an insulative housing comprising a mounting portion and a mating portion extending forwardly from the mounting portion along a longitudinal direction, the mating portion comprising a mating surface, the mounting portion comprising a top wall, first and second side walls extending downwardly from opposite sides of the top wall and a mounting space between the first side wall and the second side wall;

a plurality of first contact modules each comprising a first wafer and a plurality of first contacts fixed in the first wafer;

a plurality of second contact modules each comprising a second wafer and a plurality of second contacts fixed in the second wafer;

a plurality of third contacts each comprising a flat main portion; wherein the first contact modules, the second contact modules and the third contacts are accommodated in the mounting space and are arranged side by side along a transverse direction perpendicular to the longitudinal direction; and wherein each second contact module is sandwiched by adjacent one first contact module and adjacent one third contact; and wherein one of the first wafers and one of the second wafers cooperatively comprise mutual locking structures so that the one of the first wafers and the one of the second wafers can be inserted into the mounting space in turn under a predetermined sequence; and wherein each first wafer has a different structure on lateral sides thereof from the corresponding sides of each second wafer, each first wafer defines a first protrusion on one side and a second protrusion on another side, each second wafer defines a recess on one side for receiving the first protrusion to form the mutual locking structure and an embossment on another side.

12. The electrical connector as claimed in claim 11, wherein the one of the second wafers and one of the main portions of the third contacts cooperatively comprise mutual mating structures so that the one of the second wafers and the one of the main portions can be in lock with each other.

13. The electrical connector as claimed in claim 12, wherein the one of the main portions comprises a first cutout to receive the embossment.

14. The electrical connector as claimed in claim 11, wherein the first side wall comprises a groove to receive the second protrusion of an outmost first wafer adjacent to the first side wall.

15. The electrical connector as claimed in claim 14, wherein the outmost first wafer comprises a first slot on top of the second protrusion, and the first side wall comprises a first rib received in the first slot.

16. The electrical connector as claimed in claim 11, wherein an outmost main portion adjacent to the second side wall comprises a first projection stamped therefrom, and the second side wall comprises a second groove to receive the first projection.

17. The electrical connector as claimed in claim 16, wherein the outmost main portion comprises a second projection stamped therefrom, and the second side wall comprises a third groove to receive the second projection, the second projection being positioned under the first projection, the second projection being shorter than the first projection.

18. The electrical connector as claimed in claim 11, wherein each first contact comprises a first contact portion extending forwardly beyond the first wafer, a first mounting leg extending downwardly beyond the first wafer and a first connecting portion insert-molded in the first wafer; and wherein each second contact comprises a second contact portion extending forwardly beyond the second wafer, a second mounting leg extending downwardly beyond the second wafer and a second connecting portion insert-molded in the second wafer; and wherein each third contact comprises a plurality of third contact portion extending forwardly from the main portion and a plurality of third mounting legs extending downwardly from the main portion; and wherein the first contact portions, the second contact portions and the third contact portions are in alignment with each other along the transverse direction while the first mounting legs, the second mounting legs and the third mounting legs are offset with each other along the transverse direction.

* * * * *